United States Patent [19]

Mercer, Jr. et al.

[11] 4,156,658

[45] May 29, 1979

[54] FIXATION OF RADIOACTIVE IONS IN POROUS MEDIA WITH ION EXCHANGE GELS

[75] Inventors: Basil W. Mercer, Jr., Pasco, Wash.; Wesley L. Godfrey, Aiken, S.C.

[73] Assignee: The United States of America as represented by the United States Department of Energy, Washington, D.C.

[21] Appl. No.: 484,011

[22] Filed: Jun. 28, 1974

[51] Int. Cl.[2] ..... G21F 9/00

[52] U.S. Cl. ..... 252/301.1 W; 405/128; 405/264; 405/270

[58] Field of Search ..... 252/301.1 W, 301.1 R; 166/295; 405/128, 264, 270

[56] References Cited

U.S. PATENT DOCUMENTS

| | | | |
|---|---|---|---|
| 3,114,419 | 12/1963 | Perry et al. | 166/295 |
| 3,437,625 | 4/1969 | Bonnel et al. | 252/8.55 R |
| 3,723,338 | 3/1973 | Godfrey | 252/301.1 R |

OTHER PUBLICATIONS

Perry, J. H., Ed., *Chemical Engineers' Handbook*, McGraw-Hill Book Company, Inc., N.Y. 1950, p. 916.

*Primary Examiner*—Benjamin R. Padgett
*Assistant Examiner*—Deborah L. Kyle
*Attorney, Agent, or Firm*—Dean E. Carlson; Frank H. Jackson; Robert J. Fisher

[57] ABSTRACT

A method is provided for fixing radioactive ions in porous media by injecting into the porous media water-soluble organic monomers which are polymerizable to gel structures with ion exchange sites and polymerizing the monomers to form ion exchange gels. The ions and the particles of the porous media are thereby physically fixed in place by the gel structure and, in addition, the ions are chemically fixed by the ion exchange properties of the resulting gel.

2 Claims, 2 Drawing Figures

COMPARISON OF STRONTIUM LEACH RATE

COMPARISON OF STRONTIUM LEACH RATE

COMPARISON OF CESIUM LEACH RATE

FIXATION OF RADIOACTIVE IONS IN POROUS MEDIA WITH ION EXCHANGE GELS

CONTRACTUAL ORIGIN OF THE INVENTION

The invention described herein was made in the course of, or under, a contract with the UNITED STATES ATOMIC ENERGY COMMISSION.

BACKGROUND OF THE INVENTION

This invention relates to a method for fixing ions in porous media and is particularly directed towards the fixation of radioactive ions in soil. Although every precaution is taken to avoid release of radioactivity to the environment, it is not inconceivable that soil could be contaminated with radioactive material as a result of a leak, spill, or other accidental release. In such an event, it will be necessary to localize the contamination as much as possible and to prevent any spreading of the radioactive contamination. Radioactive contamination of soil is of grave concern as radioactive ions could be leached and migrate through the soil, eventually entering water supplies for surrounding areas. Strontium and cesium are of particular concern because of the very long half-lives of their radioactive isotopes and because of the manner in which they concentrate in certain body tissues. It is therefore essential to find techniques which ensure that the radioactive ions will remain isolated from the environment for long periods of time. While radioactive contamination can be removed for safe storage elsewhere by excavating the soil around the spill, the excavating operation itself could cause a further spreading of the contamination. Therefore, fixation of the radioactive contamination of the soil in situ is preferable to excavation. Techniques are available for immobilizing radioactive contamination of soil in situ such as by scavenging the contaminated soil by spraying the surface with a polyurethane foam which picks up contamination, soil, and rocks and forms a protective coating over the contaminated area, thereby preventing further spreading of the contamination from weathering. Another technique, disclosed by one of the present applicants in U.S. Pat. No. 3,723,338, provides for injecting into the contaminated soil a polymerizable monomer which polymerizes around the particles of the soil, immobilizing the radioactive material by physical entrapment. Unfortunately, these prior art techniques do not prove completely satisfactory in preventing the spread of leachable radioactive ions, strontium-90 and cesium-137 in particular. These ions can be leached and gradually migrate from the polymerized mass into the surrounding free soil. The present invention is an improved method for fixing such radioactive ions in the soil.

SUMMARY OF THE INVENTION

In accordance with the present invention, a method is provided for fixing radioactive ions in porous media such as soil by means of ion exchange gels. The interstices of the porous media are filled with a liquid chemical grout which subsequently forms a gel with ion exchange properties, thereby both immobilizing the ions in the structure of the gel and limiting their diffusion rate through the gel. The chemical grout contains water-soluble organic monomers which are polymerized in the presence of a catalyst to gel structures with ion exchange sites, such as carboxyl groups, which chemically fix the ions in addition to the physical retention of the materials within the gel structure.

DESCRIPTION OF THE DRAWINGS

Other features and advantages of the present invention will become apparent upon reading the following description and with reference to the drawings in which.

DESCRIPTION OF THE INVENTION

Figure 1:
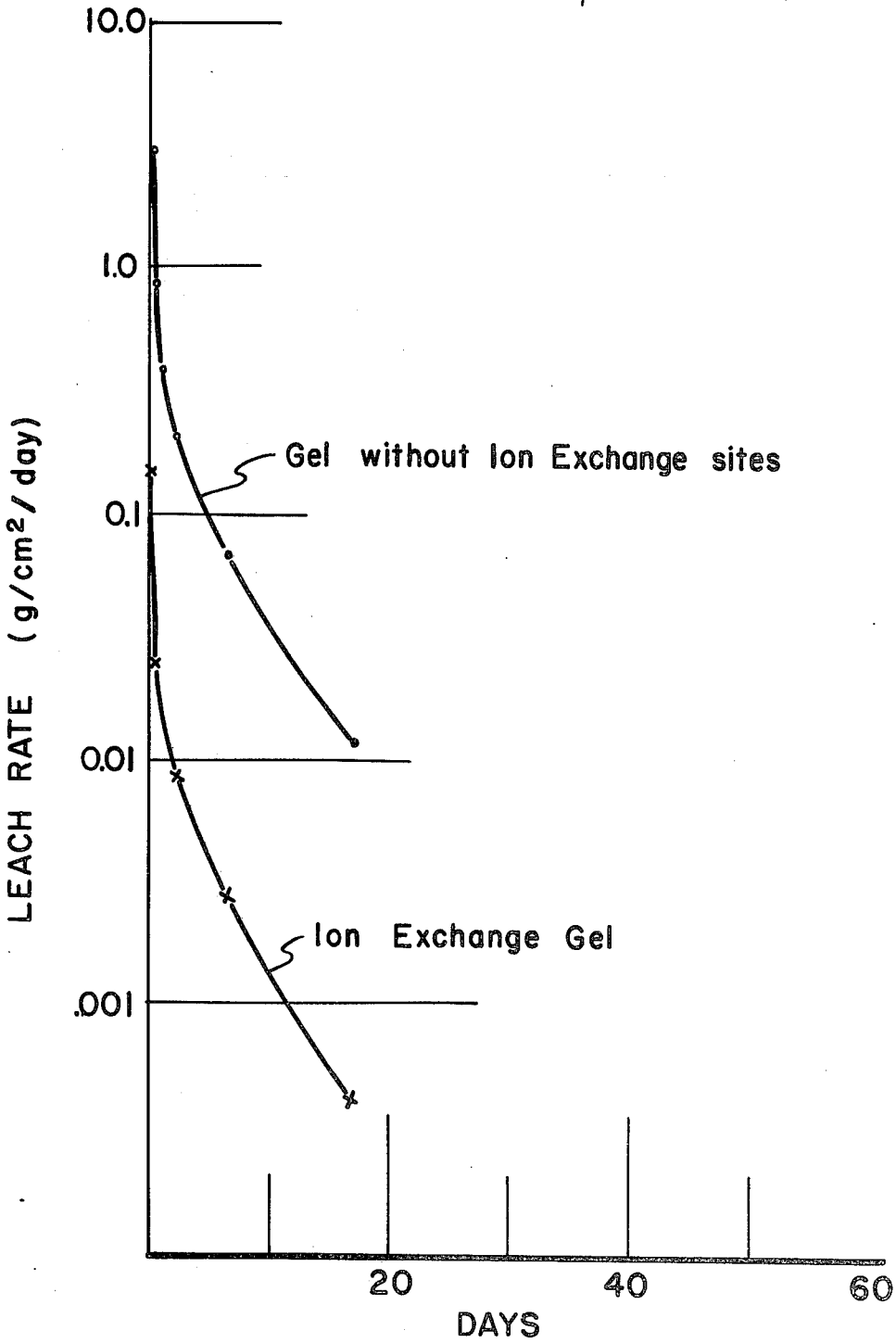
FIG. 1 is a graph showing a comparison of strontium leach rates.

The present invention provides an improved method for fixing radioactive ions in soils. Generally, the present method comprises injecting a chemical grout into the soil which contains the ions, such as radioactive ions, whose mobility is desired to be limited and fixing the ions in place in the soil. The chemical grout contains water-soluble organic monomers which are polymerizable to gel structures with ion exchange sites. Water-soluble monomers are used, as they have proven very satisfactory, whereas water-insoluble monomers are not acceptable due to inconsistent setting characteristics and difficulty in polymerizing these materials in soil. Particular types of ion exchange sites which have been found to be effective are carboxyl groups or carboxyl salts. An initiator and a catalyst for the polymerization of the monomer are injected into the soil to cause polymerization and the formation of the ion exchange gel in the soil. The soil and ions are physically fixed in place by the gel structure which surrounds the soil particles, thereby encapsulating the material and preventing mobility of the radioactive contamination through the open soil. In addition, the ion exchange properties of the gel chemically fix the ions onto the ion exchange sites, further preventing leaching and diffusion of the radioactive ions through the gel. Strontium and cesium ions are of particular concern both because the radioisotopes of these elements are very common in radioactive wastes and radioisotopes of these elements have extremely long half-lives which render them particularly hazardous. Strontium and cesium ions are readily exchanged onto and retained by the ion exchange gels.

Water-soluble organic monomers which have been found to be particularly useful in the practice of the present invention include acrylic acid, acrylates, methacrylic acid, and methacrylates. N,N′ methylene bisacrylamide has been found to be a particularly good agent for cross linking with these monomers to form gel structures with ion exchange sites. N,N′ methylene bisacrylamide has proven particularly useful because it has a relatively high solubility in water. The high solubility of this material and the water-solubility of the other organic monomers is extremely important, as it has been found that water-soluble materials are particularly effective for in situ polymerization and fixation of soils. Dispersion of these water-soluble materials from the point of injection through the soil containing the contamination is far better than with water-insoluble materials; and it has also been found that the water-soluble organic monomers are far more readily polymerized in soil than the water-insoluble materials.

The effectiveness of the particular method for fixing ions and the effect of the ion exchange properties of the material in reducing the mobility of ions through the gel is illustrated by the following examples:

A chemical grout which forms an ion exchange gel was prepared by dissolving sufficient AM-9 (a product of American Cyanamid Company containing acrylamide and N,N' methylene bisacrylamide, and which, based on solubility tests, is believed to contain less than 10% N,N' methylene bisacrylamide and mostly acrylamide), sodium acrylate and N,N' methylene bisacrylamide to give a solution containing 9% AM-9, 1% acrylate as sodium acrylate, and 1.8% N,N' methylene bisacrylamide. Radioactive strontium was added to give a concentration of 0.0007 microcurie of $^{85}Sr$ per liter of grout. The grout was then treated while mixing with 1.5% of catalyst, β-dimethylaminopropionitrile (DMAPN) followed by 1% of initiator, ammonium persulfate (AP), to begin the polymerization process. The acrylamide and sodium acrylate cross-links with the N,N' methylene bisacrylamide to produce a stable gel. The sodium acrylate forms ion exchange sites (carboxyl group) on the gel structure. The solution was divided into 75 ml portions placed in polyethylene containers and allowed to gel.

A grout which produces a gel without ion exchange properties was prepared by repeating the above steps with the exception that 10% AM-9 was used and no sodium acrylate was added.

When gelation was complete, the gel surface was leached with a 50 ml aliquot of tap water to determine the $^{85}Sr$ leach rate as a function of time. After various time intervals, the supernatant liquid was decanted and replaced with a fresh 50 ml aliquot of tap water. The leach water was not agitated or stirred during contact with the gel except during addition and removal. Measured portions of the leach water were analyzed to determine the $^{85}Sr$ concentrations. The leach rate, which is a function of the diffusion rate, is computed from the following equation:

$$\text{leach rate, g/cm}^2\text{/day} = \frac{\text{activity leached/cm}^2\text{-day}}{\text{activity/g of gel mixture}}$$

The leach rate as shown above is an apparent dissolution rate of the gel which does not actually take place. Only soluble substances (i.e., ions) are removed from the gel. Appropriate corrections were included in the computation to account for the decay of $^{85}Sr$ which has a half-life of 65 days.

The $^{85}Sr$ leach rate for the ion exchange gel is compared with that of the gel without ion exchange properties in FIG. 1, which is a graph of the leach rate in grams/cm$^2$/day versus time in days. As is apparent from the graph, the strontium leach rate from the ion exchange gel was only 10% or less than that for the gel without ion exchange sites.

Figure 2:
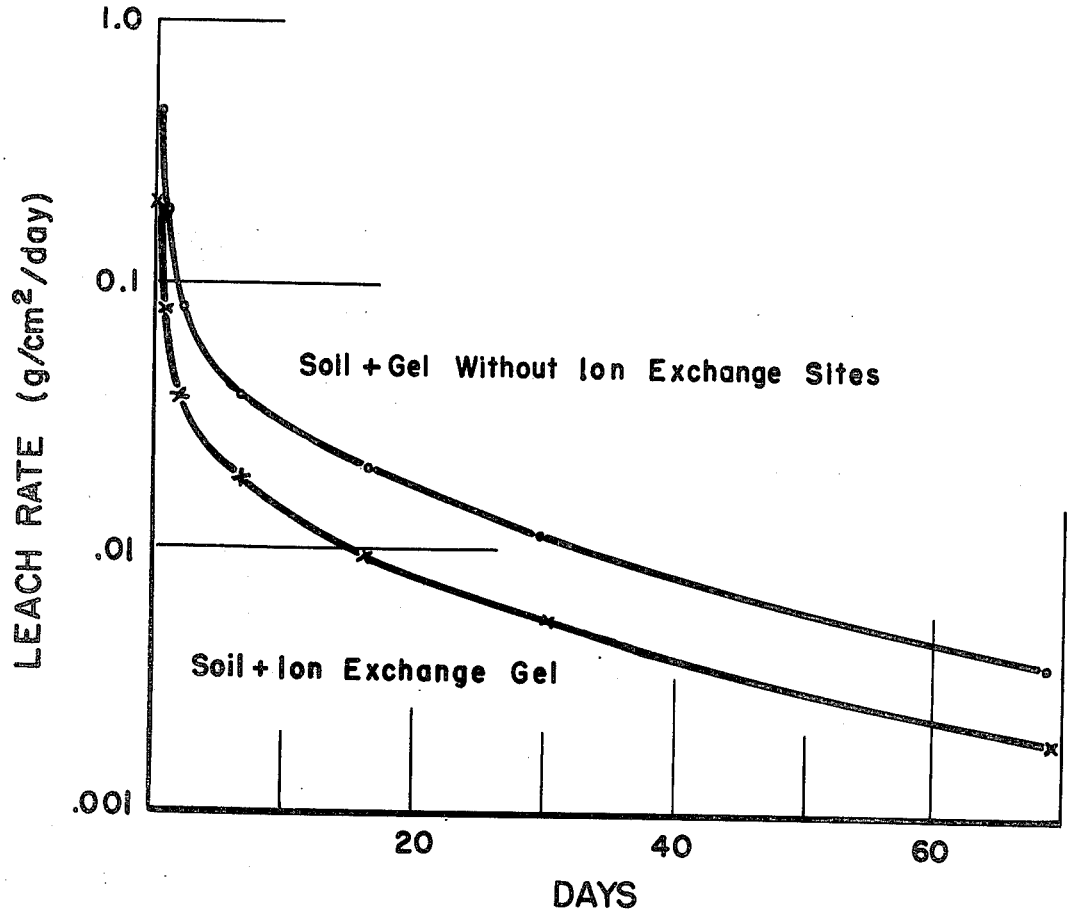
FIG. 2 is a graph showing a comparison of cesium leach rates.

The cesium leach rate from soil-gel mixtures was also determined using soil based with cesium traced with $^{134}Cs$. Chemical grout solutions were prepared as above except no $^{85}Sr$ tracer was added and the amount of AP was double to promote gelation in the presence of soil. 100 cm$^3$ of packed soil was mixed with 50 ml of catalyzed grout, separated into two portions, and placed in polyethylene containers to gel. The surfaces of the soil-gel mixtures were scraped to remove a very small excess of gel and were then leached with successive volumes (33 ml) of tap water over a two-month period. The results of these soil-gel leaching experiments are illustrated in FIG. 2, which is a graph of the leach rate in grams/cm$^2$/day versus time in days. It can be seen from this graph that the cesium leach rate from the ion exchange gel is only about half that from the gel without ion exchange properties. The ion exchange gels are expected to be more effective for reducing the leaching rate of divalent ions, such as strontium, than of univalent ions, such as cesium, because of the high attractive forces in the gel for the divalent ions where in contact with low ionic strength solutions, such as tap water.

Consequently, it can be seen that, while present techniques exist for polymerizing material in soil to immobilize radioactive materials, the present technique of using water-soluble monomers which are polymerizable to gel structures with ion exchange sites provides advantages of improved dispersion and polymerization in the soils and improved immobilizing ability by the chemical retention of radioactive ions over and above the physical fixation.

The embodiments of the invention in which an exclusive property or privilege is claimed are defined as follows:

1. A method for fixing radioactive ions in soil comprising: injecting a chemical grout into the soil which contains said radioactive ions, said chemical grout containing sodium acrylate, acrylamide and N,N' methylene bisacrylamide which will polymerize to form gel structures with ion exchange sites; and injecting an initiator and a catalyst for the polymerization into said soil to cause polymerization and the formation of an ion exchange gel in said soil whereby the soil and ions are physically fixed in place by the gel structure and in addition the ions are chemically fixed by the ion exchange properties of the gel.

2. The method of claim 1 wherein said catalyst for the polymerization is β-dimethylaminopropionitrile and said initiator is ammonium persulfate.

* * * * *